United States Patent [19]

Morgan et al.

[11] 4,380,940

[45] Apr. 26, 1983

[54] NO TORQUE TOOL

[75] Inventors: Ronald E. Morgan, Biggleswade; Thomas Pearce, Beckenham, both of England

[73] Assignee: British Gas Corporation, London, England

[21] Appl. No.: 250,770

[22] Filed: Apr. 3, 1981

[30] Foreign Application Priority Data

Nov. 11, 1980 [GB] United Kingdom ..... 8036117

[51] Int. Cl.[3] ..... B25B 17/00

[52] U.S. Cl. ..... 81/57.16

[58] Field of Search ..... 81/57.16, 57.34, 57.29, 81/57.3

[56] References Cited

U.S. PATENT DOCUMENTS

| | | | |
|---|---|---|---|
| 1,808,959 | 6/1931 | Lane et al. | 81/57.29 |
| 2,450,967 | 10/1948 | Keiser | 81/57.34 |
| 3,880,024 | 4/1975 | Asada | 81/57.34 |
| 4,215,599 | 8/1980 | Batchelder | 81/57.29 |
| 4,309,923 | 1/1982 | Wilmeth | 81/57.39 |

*Primary Examiner*—James L. Jones, Jr.

*Attorney, Agent, or Firm*—Larson and Taylor

[57] ABSTRACT

A tool for mounting a fitting on a pipe or demounting it therefrom without the application of torque to the pipe comprises two clamping member mounted on a coupling member together with means for applying a torque to the fitting.

5 Claims, 5 Drawing Figures

FIG.3.
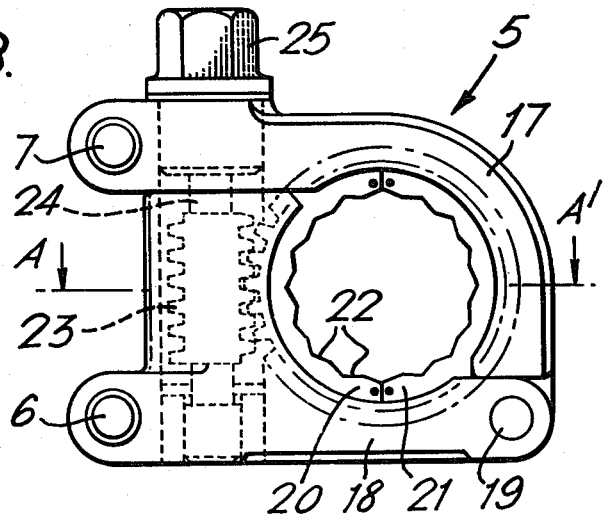
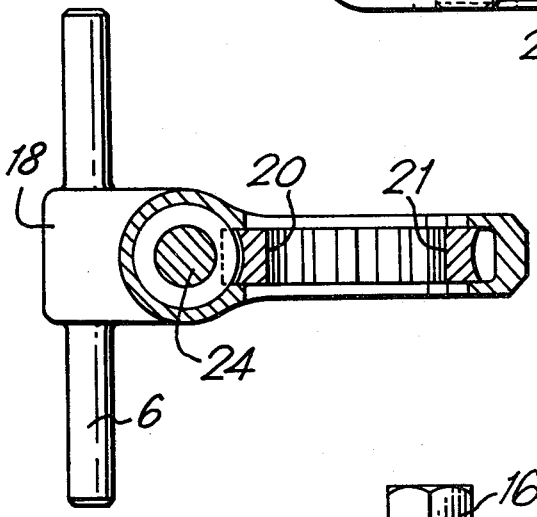
FIG.4.
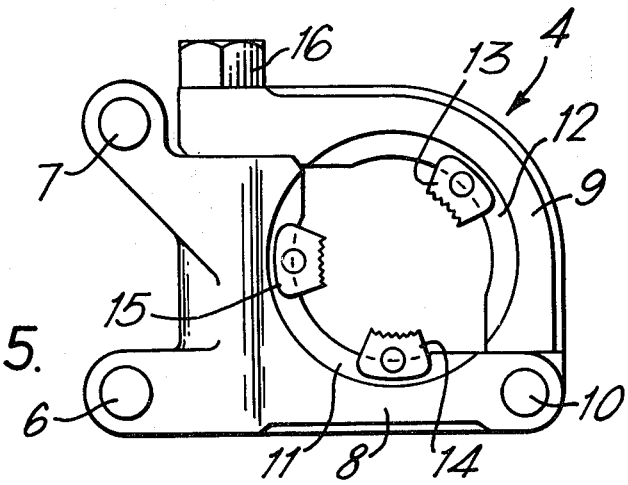
FIG.5.

NO TORQUE TOOL

DESCRIPTION

This invention relates to devices for assembling and disassembling components coupled by means of a screw thread. It finds particular application in the mountings of fittings on and their removal from service pipes such as gas pipes without the application of extraneous torque to the pipe and the consequent disturbance of other screw-threaded joints.

During the servicing of fittings attached to service pipes, particularly gas meter control cocks, a frequent problem is that other joints in the pipes are disturbed and leaks may occur. Conventionally, such fittings are disassembled and dissembled using two pairs of pipe wrenches, one of which holds the pipe whilst the other holds the fitting. If the joint is particularly tight, the wrench holding the pipe may slip and a fitting in the supply pipe may become loose causing gas leakage.

In order to overcome this problem a tool has been devised having an independent restraining body to which the service pipe is clamped whilst torque is applied to the fitting.

According to the present invention there is provided a device for coupling a first component to a second component by means of a screw thread or decoupling a first such component from a second such component, comprising restraining means, first demountable clamping means rigidly attachable to said restraining means and adapted to clamp said first component, and second demountable clamping means also rigidly attachable to said restraining means wherein said second demountable clamping means comprises retaining means and gripping means for said second component rotatable with respect to said retaining means to apply a torque to said second component.

An embodiment of the invention will now be described by way of example with reference to the accompanying drawings in which:

FIG. 3 is a view of a part of the device of FIG. 1

FIG. 4 is a section along the line AA′ of FIG. 3; and

FIG. 5 is a view corresponding to that of FIG. 3 of the pipe clamping means mounted to assemble a gas cock on a service pipe.

Figure 1:
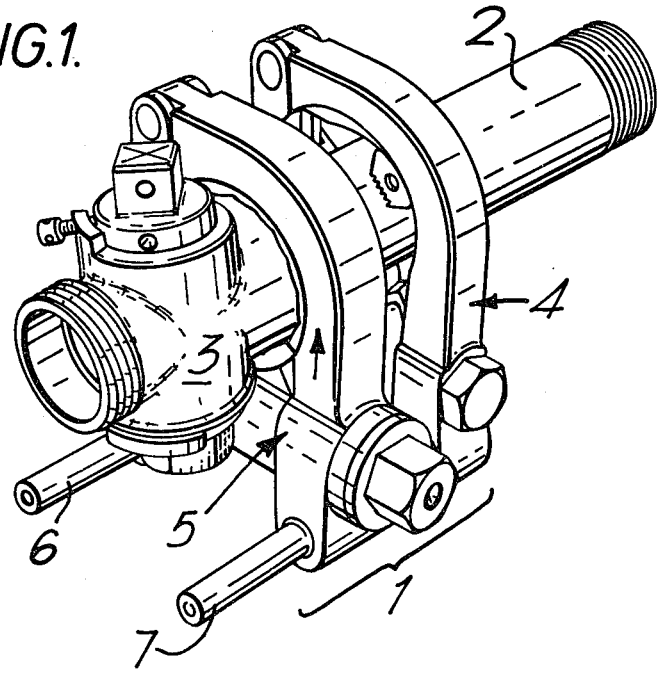
FIG. 1 shows a device in accordance with an embodiment of the invention mounted to disassemble a gas cock from a service pipe

Referring now to FIG. 1, this shows a tool 1 mounted on a pipe 2 ready to unscrew a gas cock 3 therefrom. The tool comprises a first clamping means 4 which grips the pipe and a second clamping means 5 which grips the gas cock, both clamping means being mounted on restraining means consisting of a pair of rods 6,7. The first clamping means 4 (FIG. 5) comprises a pair of retaining arms 8,9, coupled by a hinge 10. Demountably held by the arms are jaw retaining members 11,12 to which are attached jaws 13–15 which grip the pipe. Alternative sets of jaws may be applied to accommodate different pipe sizes. The arms are urged together by means of an assembly bolt 16 which causes the jaws to grip the pipe firmly and couple it securely to the rods 6,7.

The second clamping means 5 (FIGS. 3,4) also has two retaining arms 17,18 coupled by a hinge 19. These arms are grooved and act as a guide to a split gripping members 20,21 having indentations 22 to grip a fitting such as a gas cock. The outer periphery of the gripping member 20,21 is toothed and cooperates with a worm 23 mounted on an axle 24. The axle is rotatable by means of a head 25 to which a spanner or the like may be applied. With a right-hand thread, rotating the axle clockwise causes the fitting to be clamped and a releasing torque to be applied thereto. Anticlockwise rotation causes the axle to be withdrawn from its guide.

Figure 2:
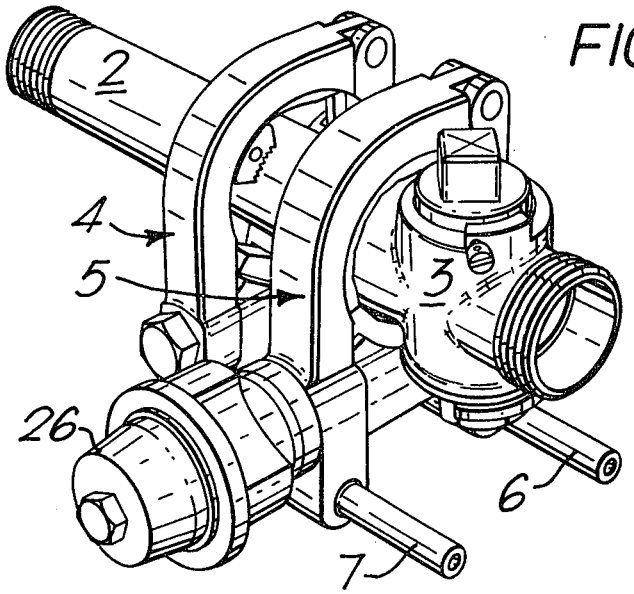
FIG. 2 shows a device mounted to assemble a gas cock on a service pipe

In order to fit a replacement valve, the tool is assembled the opposite way round as shown in FIG. 2.

When tightening a fitting, a torque-limiting device 26 may advantageously be used.

A device of the type described may conveniently be used in inaccessible positions such as the corners of rooms or in cupboards. Different clamping means may be fitted to accommodate different pipe sizes and variations in fittings. Its use is not limited to unscrewing fittings from service pipes; it may, for example, be used in like manner to assemble or disassemble compression joints or cable glands.

We claim:

1. A device for coupling a first component to a second component by means of a screw thread or decoupling a first such component from a second such component, said device comprising restraining means, first demountable clamping means, rigidly attached to said restraining means, for clamping said first component, and second demountable clamping means rigidly attached to said restraining means, said second demountable clamping means comprising retaining means and gripping means for gripping said second component comprising a split gripping member mounted within said restraining means and rotatable with respect to said retaining means, said gripping member including a toothed portion located on the outer periphery thereof and said gripping means further comprising a worm for, when rotated, driving said toothed portion of the gripping member so as to apply a torque to said second component.

2. A device as claimed in claim 1 wherein said first demountable clamping means includes gripping means adapted to grip said first component.

3. A device as claimed in claim 2 wherein said gripping means of said first demountable clamping means is demountable.

4. A device as claimed in claim 1 wherein the gripping means of said second clamping means is demountable.

5. A device as claimed in claim 1 further including means for limiting the torque applied to said second component.

* * * * *